US005811764A

United States Patent [19]

Hirst

[11] Patent Number: 5,811,764

[45] Date of Patent: Sep. 22, 1998

[54] METHOD FOR REDUCING FLICKER IN ELECTROPHOTOGRAPHIC PRINTERS AND COPIERS

[75] Inventor: B. Mark Hirst, Boise, Id.

[73] Assignee: Hewlett-Packard Company, Palo Alto, Calif.

[21] Appl. No.: 701,899

[22] Filed: Aug. 23, 1996

[51] Int. Cl.[6] ..... H05B 1/02

[52] U.S. Cl. ..... 219/497; 219/501; 219/505; 219/485; 374/107; 323/300

[58] Field of Search ..... 219/216, 481, 219/483, 485, 486, 494, 497, 499, 501, 505, 519; 323/235, 236, 319, 300; 363/74; 374/102, 107

[56] References Cited

U.S. PATENT DOCUMENTS 4,928,055 5/1990 Kaieda et al. ..... 323/300

5,483,149 1/1996 Barrett ..... 323/300

*Primary Examiner*—Mark H. Paschall

*Attorney, Agent, or Firm*—Anthony J Baca

[57] ABSTRACT

The present invention is a control system for controlling the temperature of the fusing system. This control system utilizes the knowledge of the heating characteristics of the fuser filament along with the knowledge that the human eye is most sensitive to temporal changes near the 8 Hz to 10 Hz rate as well as the concept of shape factors to control the rate at which power is applied to the filament to bring the fusing system up to operating temperature. From the study of the electrical characteristics of the heating element it is known that the heating element resistance in the fusing system under study exhibits a thermal time constant of 330 mS while heating. Also, from the summary of flicker regulations it is known that the best reduction in flicker is for the case in which a ramp voltage change is implemented with a ramp time of at least 1 second.

20 Claims, 5 Drawing Sheets

METHOD FOR REDUCING FLICKER IN ELECTROPHOTOGRAPHIC PRINTERS AND COPIERS

CROSS-REFERENCE TO RELATED APPLICATION

The present application is related to the following co-pending U.S. Patent applications being assigned to the same assignee and filled on the same date, entitled:

"A REDUCED FLICKER FUSING SYSTEM FOR USE IN ELECTROPHOTOGRAPHIC PRINTERS AND COPIERS", Ser. No. 08/704,216 incorporated herein by reference;

"USE OF THE TEMPERATURE GRADIENT TO DETERMINE THE SOURCE VOLTAGE", Ser. No. 08/704,217 incorporated herein by reference; and "A UNIVERSAL POWER SUPPLY FOR MULTIPLE LOADS", Ser. No. 08/697,387 incorporated herein by reference.

TECHNICAL FIELD

This invention relates generally to power control systems and more particular to a method for controlling the amount of power supplied to a electrophotographic printer or copier while reducing flicker.

BACKGROUND OF THE INVENTION

Starting in approximately 1984 low cost personal laser printers became available. Almost all laser printers manufactured worldwide to date suffer from excessive flicker as measured by the proposed European regulatory document IEC 555-3. Flicker is defined as the impression of unsteadiness of visual sensation induced by a light stimulus whose luminance or spectral distribution fluctuates with time. In electrical power distribution systems flicker is the result of large current changes reacting with the power distribution system impedance causing voltage fluctuations. These voltage fluctuations, in the form of voltage sags and surges, cause the light output of incandescent lamps to fluctuate and can cause fluorescent lamps to drop out. Flicker in incandescent lamps is easily noticed because photonic emissions for incandescent lamps is a nonlinear function of the voltage source and any voltage deviation causes a much larger deviation in the luminescent intensity of the light emitted from the incandescent lamp. Light flicker is visually irritating and also represents unwanted harmonics and power transients being placed on a power system.

All dry electrophotographic copiers and printers develop an image utilizing a dry toner. The typical toner is composed of styrene acrylic resin, a pigment-typically carbon black, and a charge control dye to endow the toner with the desired tribocharging properties for developing a latent electrostatic image. Styrene acrylic resin is a thermo-plastic which can be melted and fused to the desired medium, typically paper.

The typical fusing system in an electrophotographic printer or copier is composed of two heated platen rollers which, when print media with a developed image pass between them, melt the toner and through pressure physically fuse the molten thermal plastic to the medium. Heating is usually accomplished by placing a high power tungsten filament quartz lamp inside the hollow platen roller.

There are numerous reasons to intelligently control a electrophotographic printer or copier fusing system in a much more aggressive manner. First, intelligent control can result in a universal fuser that can be shipped to any commercial market worldwide regardless of the power system. The universal fuser is a fusing system which can be connected to any low voltage public power system worldwide. Second, a flicker free universal fuser has the attractive benefit of requiring a single part for both manufacture and field service replacement. The manufacturer is relieved of the burden of manufacturing 110 VAC and 220 VAC printers. The need to stock two types of service parts is eliminated, and product distribution centers now have one product that can be shipped to any country in the world without any reconfiguration requirements. There are reduced logistical burdens for sales, distribution and manufacture scheduling. As can be expected there is a large financial advantage to be gained by producing only a single version of a product for worldwide consumption.

For a dry electrophotographic fusing system to operate worldwide it must be able to operate satisfactorily on AC power systems providing from 90 Vrms to 240 Vrms at frequencies of 50 Hz to 60 Hz. The fusing system must heat up from ambient room temperature to operating temperature as quickly as possible while exhibiting extremely low flicker as its power consumption level changes. The fusing system, when combined with the balance of the electrophotographic printer power electronics, must meet International Electrical Commission (IEC) regulations IEC 555-2 and IEC 555-3 for current harmonics and flicker. The printer must pass Federal Communications Commission (FCC) class B regulations for power line conducted emissions and radiated emissions. In addition, the printer must pass CISPR B requirements for power line conducted emissions and radiated emissions. Finally, the printer must not suffer from excessive acoustic multi-tone or single tone emissions in the human auditory range in the office environment. The fusing system must be capable of switching into a power down or power off mode for energy savings as suggested by the EPA Energy Star Program. The absolute cost of any additional electronics is limited to no more than the cost benefit of not stocking multiple 110 VAC and 220 VAC models.

U.S. Pat. No. 5,483,149 to Barrett (herein referred to as Barrett) shows that a universal fuser may be obtained through the use of a modified integral half cycle (IHC) power controller but without solving the flicker problem at high power. The method taught by Barrett has been shown to suffer some flicker problems as well as placing current sub-harmonics on the AC power system. Currently no regulation exists regarding AC current sub-harmonic content.

Other methods such as phase control, in which a triac's conduction angle is ramped up relatively slowly, have proven to yield a universal fusing system which meets IEC 555-3 specifications. In U.S. Pat. No. 4,928,055 to Kaieda et al. (herein referred to as Kaieda) a fuser power control system based on phase delay gated triac control of an AC heating system is taught.

Details about the proposed international standard for regulating flicker can be found in, "A REDUCED FLICKER FUSING SYSTEM FOR USE IN ELECTROPHOTOGRAPHIC PRINTERS AND COPIERS", Ser. No. 08/704,216.

An objective of the present invention is to eliminate or at least dramatically reduce the flicker exhibited by the fusing systems of electrophotographic printers and copiers. Briefly restated, flicker is the annoying visual perception of ambient light fluctuations within the home or work place due to large transient power loads inducing voltage sag on the low voltage public power distribution system. An important benefit of the implementation of the flicker solution described herein is the automatic attainment of a universal fuser.

The power control design methods described herein solve the flicker problem, yield a universal fusing system, provides linear power control as a function of duty cycle, eliminates virtually all current harmonics, and presents a near unity power factor to the AC power system at low cost.

SUMMARY OF THE INVENTION

The present invention provides a method for controlling a temperature of a heating element while generating low flicker. The method starts by determining the input voltage. This can be accomplished by allowing the heading element to consume an initial amount of power. By measuring a rate of change in the temperature of the heating element the input voltage can be determined. Based on the input voltage, the maximum and minimum amount of power that can be consumed and other controller dynamics are set. Power to the heating element is smoothly ramped up over a period of time from the initial amount to the maximum amount. After the heating element reaches operating temperature a temperature control process is invoked. The temperature control process controls the temperature of the heating element.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

The present invention is not limited to a specific embodiment illustrated herein. The present invention is a control system for controlling the temperature of the fusing system. This control system utilizes the knowledge of the heating characteristics of the fuser filament along with the knowledge that the human eye is most sensitive to temporal changes near the 8 Hz to 10 Hz rate as well as the concept of shape factors to control the rate at which power is applied to the filament to bring the fusing system up to operating temperature. From the study of the electrical characteristics of the heating element it is known that the heating element resistance in the fusing system under study exhibits a thermal time constant of 330 mS while heating. Also, from the summary of flicker regulations it is known that the best reduction in flicker is for the case in which a ramp voltage change is implemented with a ramp time of at least 1 second.

Figure 3:
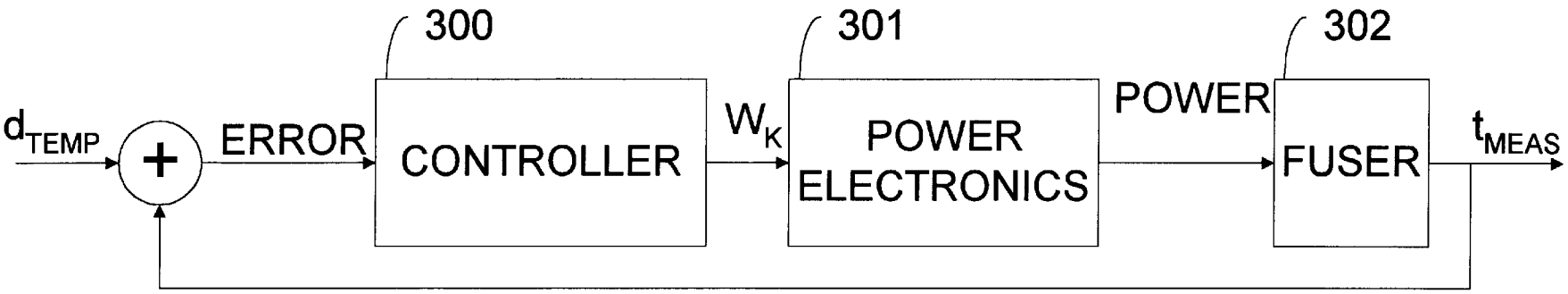
FIG. 3 is a block diagram of a conventional feedback fuser temperature control system.

The conventional foundation for feedback control is presented in block form in FIG. 3 where the input to the system is the desired fuser temperature, $d_{temp}$, and the feedback quantity is the measured fuser temperature, $t_{meas}$. The temperature error signal is supplied as in input to the controller 300 whose output, $W_k$, directly controls the duty cycle of the pulse width modulator in the power electronics block 301.

The controller 300 of FIG. 3 may be of the PID (proportional, integral, derivative) or adaptive type and could contain detailed models of the dynamics of the fusing system. The power electronics 301 can be considered a linear power amplifier which possess fast dynamics. Fuser 302 on the other hand will possess considerably slower dynamics and it may prove necessary to include these dynamics in the design of temperature controller for either performance or stability reasons.

The typical temperature controller drives a triac based power controller. The triac based power controller provides ease of implementation at a low cost. The triac based system may be controlled by an integral half cycle controller (IHC) in which a number of half cycles of AC power are supplied to the fusing system and a number of half cycles of no power are supplied to the fuser. The ratio of the number of power cycles to the total of the power cycles plus the non-power cycles is called the duty cycle of the IHC controller. A triac based system may also be controlled by a phase control system which allows the triac to supply power to the fuser for discrete portions of the AC half cycle. The portion of the AC cycle in which the triac is conducting is known as the conduction angle.

Both phase control and IHC control may yield universal voltage interface fusing systems when given information concerning zero cross of the AC voltage and AC voltage magnitude. IHC control may give satisfactory flicker performance at low power levels through a pseudo-randomizing of the conduction half cycles. Phase control can yield satisfactory flicker performance if the control system which is controlling its conduction angle is designed properly.

Alternatively, the temperature controller may drive an off-line switch mode type power controllers as described in co-pending application "A REDUCED FLICKER FUSING SYSTEM FOR USE IN ELECTROPHOTOGRAPHIC PRINTERS AND COPIERS", Ser. No. 08/704,216, yields a universal voltage interface without need of voltage zero cross timing information. This off-line switch mode power controller draws power continuously from the AC line and present a nearly purely resistive load to the AC source. Thus, it yields a universal voltage interface, produces minimal current harmonics, and exhibits excellent power factor.

Before the temperature can be regulated the source voltage must be determined. Several methods exist, however, in the preferred embodiment, it is determined by limiting the duty cycle or conduction angle at such a value as to limit the power drawn for the highest expected source voltage. This allows a portion of the available power to be supplied to the fusing system. The magnitude of this power is proportional to the source voltage. The power supplied to the fuser causes the fuser temperature to increase to the point at which it reaches an equilibrium temperature. The rate of change of the temperature is proportional to the source voltage. By measuring the gradient of the temperature after application of a portion of the available power the source voltage may be determined. Additional description of this approach for determine the source voltage can be found in co-pending application "USE OF THE TEMPERATURE GRADIENT TO DETERMINE THE SOURCE VOLTAGE", Ser. No. 08/704,217. Other ways include directly sensing the voltage or having the user supply the information.

Once the source voltage has been determined, the fuser temperature control process is started. The preferred embodiment fusing system has at least four discrete modes of operation: warm-up, operation, idle, and power-save. During the warm-up mode of operation the maximum available power is supplied to the fuser so that it may be warmed from some ambient temperature to operating temperatures as quickly as possible. During operating mode the power levels supplied to the fuser oscillate due to the transient power loads of printed media passing through the fusing system. In idle mode the target temperature of the fusing system is reduced and media loads are no longer passing through the fusing system. The temperature controller is still oscillating but the average power required to maintain idle temperatures in the fusing system is typically reduced by a factor of 10 over the active power levels. When the printer enters the power-save mode the power to the fusing system is completely turned off to minimize the power required by the printer.

For the fuser temperature controller and associated power electronics to produce minimum flicker levels special attention must be paid to the controller output during transitions between the various operating modes of the fusing system. In order to minimize the flicker produced by the temperature controller and power electronics the temperature controller must smoothly change the controller output during the transitions between the various operating mode. The rate of change of the controller output is balanced against the flicker levels produced and the required fuser temperature response characteristics.

Figure 1:
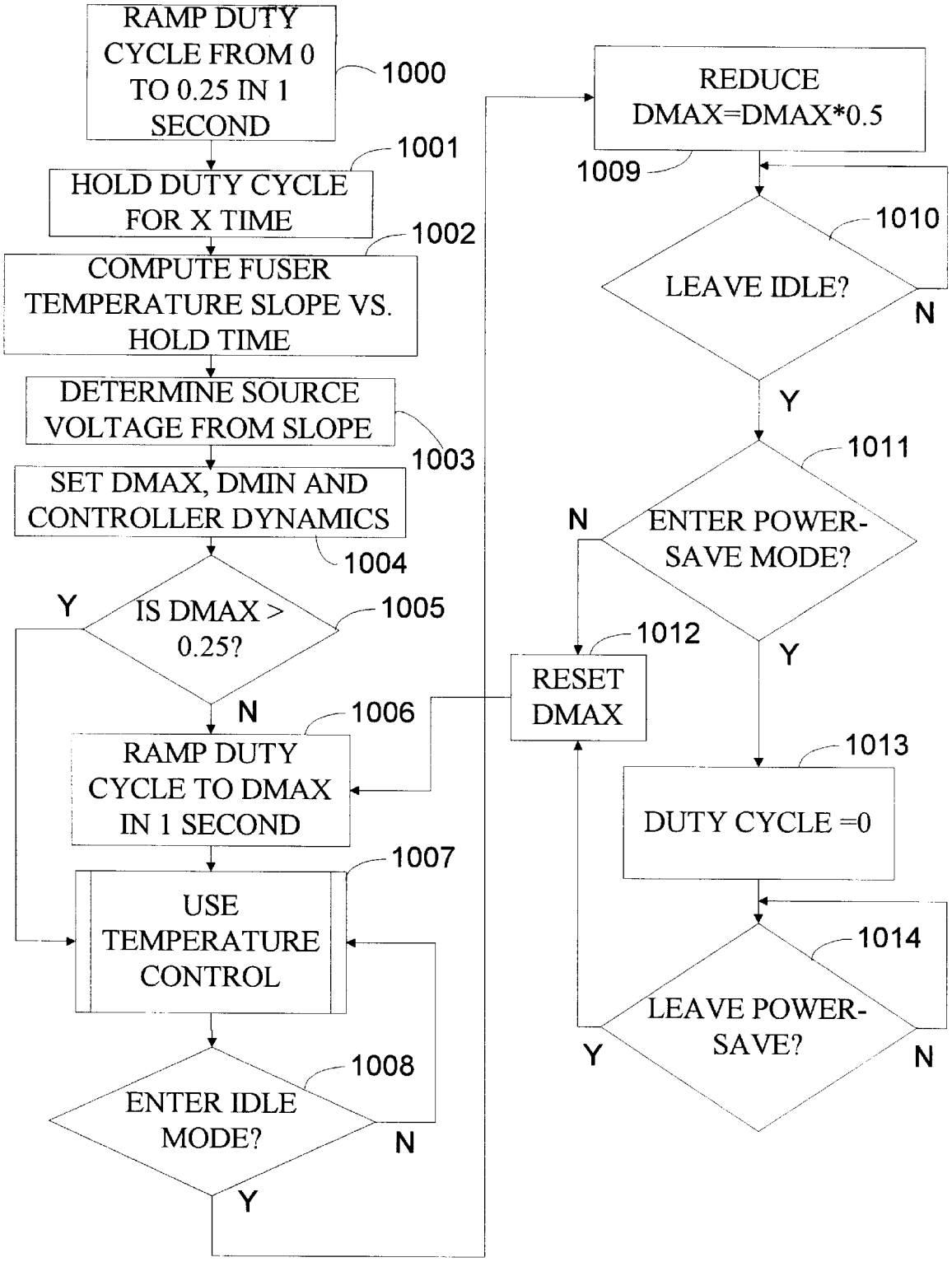
FIG. 1 is a flow chart showing the overall control process.

With that high level description, the fuser temperature control system will now be described in more detail. The fuser temperature control system resides within software or firmware executed by a digital computer. Referring now to FIG. 1, where a flow chart showing the preferred embodiment of the overall control system is presented. First, the control system determines the input voltage. The duty cycle is ramped from 0 to 0.25 over a 1 second period 1000. The ramp interval determines the shape factor and may be shorter of longer, however a time of at least 1 second will provide the maximum flicker reduction. Also, the final value of 0.25 correlates to the maximum value of the duty cycle for the highest specified input voltage of 220 Vrms. Other fuser systems may have a different value associated with the maximum voltage.

The duty cycle is held at 0.25 for a time as the fuser temperature increases 1001. The exact amount of time must be determined for each application because it depends on the thermal mass and transport lag of the fuser system. A time of 20 seconds was used for the fuser system of the printer under test. The temperature slope is determined from the time interval and the fuser temperature 1002. From the slope, the source voltage can be determined 1003.

To insure safe operation of the fuser, a maximum duty cycle ($D_{MAX}$) is assigned based on the source voltage, controller dynamics are adjusted and a minimum duty cycle is set 1004. If the duty cycle is not already at $D_{MAX}$ 1005, then it is ramped up to $D_{MAX}$ over a 1 second period 1006. After the duty cycle has reached $D_{MAX}$, the temperature control process for maintaining the proper temperature is invoked. This process is described in more detail below. At the same time, the controller dynamics may be set for optimum performance for a given source voltage.

Once printing is complete, the fuser enters the idle mode 1008, by ramping down $D_{MAX}$ by 50%. The printer may exit the idle mode 1010 to enter either the printing mode or the power save mode. If the printer enters power save mode, 1011, the power to the fuser is turned off by ramping the duty cycle down to zero 1013. To exit either power save or idle mode, $D_{MAX}$ must be reset 1012 to its original value as determined in 1004.

The temperature control system of FIG. 3 utilizes only one feedback quantity, the temperature of the fusing system 302. This results in the lowest cost implementation as an extremely low cost microcontroller (4001 of FIG. 5) may be used to implement the control system 300. Because most printer and copier control computers already measure the temperature of the fusing system, the best approach in a commercial implementation is to utilize the existing A/D 4000 already used by the microprocessor 4001 in the printer or copier engine. Typically, the temperature sensor consists of a negative temperature coefficient thermistor in a voltage divider network coupled to a first order low pass filter to remove high frequency noise. The bandwidth of the thermistor and low pass filter is relatively low, approximately 20 Hz, but much higher than the bandwidth of the fusing system.

One of the criteria that is used to compare competing laser printers and copiers against one another is the time required for the fusing mechanism to heat up from the "cold" state to the temperatures necessary for proper fusing. Due to the thermal mass of the fuser platens a large amount of energy is necessary to bring the fusing system up to operating temperature as fast as is reasonably possible. There are also limits to the available power levels that can be drawn from the household or office low voltage distribution system with the maximum available power level for worldwide use being approximately 1200 watts.

After fuser 302 has been brought up to operating temperature the amount of energy necessary for maintaining temperature and providing enough energy for proper fusing of toner to the print media is greatly diminished. Therefore, maximum power supplied to fuser 302 can be reduced. Of course the average power required changes greatly depending upon the thermal load of various media such differing paper weights and sizes as well as different media types such as overhead transparencies. The average power levels required for proper fusing also change as the amount of moisture in the paper varies with the changing relative humidity.

Figure 2:
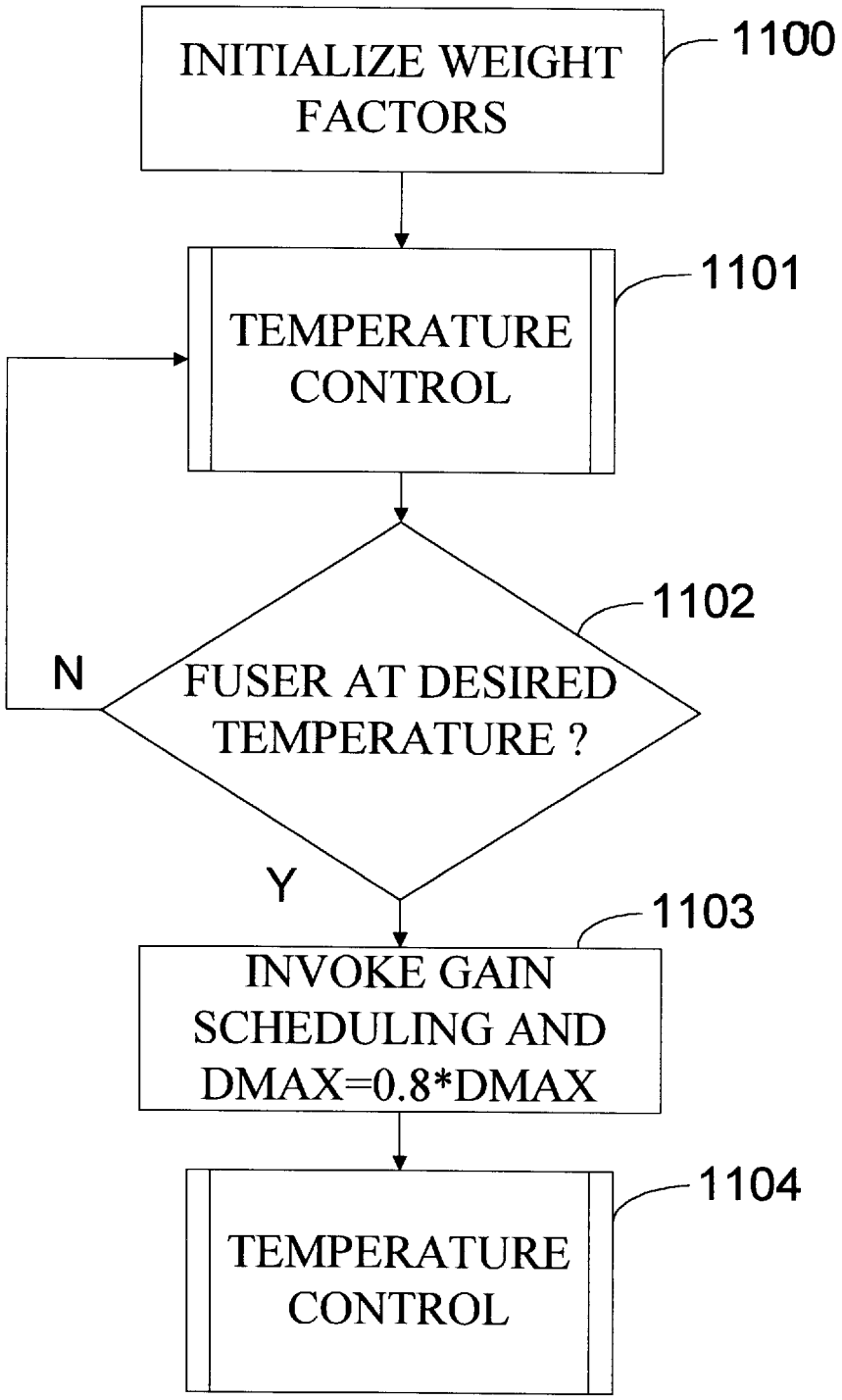
FIG. 2 is a flow chart showing the adaptive temperature control process.

The preferred embodiment of the temperature control system 1007 is shown in more detail in FIG. 2. It may be designed with either traditional control techniques and translated into the discrete time domain or it can be designed completely in the discrete time domain.

Fuser temperature control 1007 uses gain scheduling and maximum duty cycle limiting 1103 upon fuser 302 reaching its proper operating temperature 1102 in order to further reduce the flicker generated by the fusing system. After the initial warm-up period 1100, 1101, once the fusing system reaches its operating temperature 1102, the maximum duty cycle is reduced by 20% and the ramp rate is reduced from approximately 1.25 seconds to approximately 6 seconds 1103. The adaptive temperature control process 1104 then continues. Because the fuser is now near operating temperature, not as much power is necessary to compensate for thermal losses and paper thermal loading thus, the maximum filament power is lowered in order to reduce flicker.

Gain scheduling (1103 of FIG. 2) slows down the ramp rate of the temperature controller once fuser 302 is near operating temperature. Also the maximum power supplied to fuser 302 is reduced by limiting the maximum duty cycle of pulse width modulator. Setting a maximum allowable duty cycle after fuser 302 has reached operating temperature is very easily accomplished in the algorithms which implement the temperature control program.

Experiments have shown that combining the concepts of gain scheduling and maximum power limiting once the fusing system has reached operating temperatures can reduce the flicker levels produced by the fusing system by a factor of 3 without degradation of the temperature control performance of the fusing system.

Turning now to the controller process. As stated above, the temperature controller may be of the PID or adaptive type. A PID controller can be shown to be of the form of $$w_n=w_{n-1}+k_0e_n+k_1e_{n-1}+k_2e_{n-2} \quad \text{eq. 1}$$

where $e_n$ is the present controller error, $e_{n-1}$ is the last controller error, $e_{n-2}$ and is the second last controller error and the constants $k_0$, $k_1$, and $k_2$ are $$k_0=k_p+k_iT+k_d/T \quad \text{eq. 2}$$

$$k_1=-k_p-2k_d/T \quad \text{eq. 3}$$

$$k_2=k_d/T \quad \text{eq. 4}$$

where kp, ki, and kd are the desired proportional, integral, and derivative gains and T is the sample period of the digital controller.

The selection of the proportional, integral, and derivative gains may be obtained through iterative experimentation, tuning based on measured process reaction curves as suggested by Zeigler-Nichols tuning, or though modeling of the closed loop frequency response of the fusing system coupled with the digital controller.

To minimize the flicker produced by the overall fuser temperature controller and power electronics the controller output must have no more than a few hertz of bandwidth with a bandwidth of less than one hertz being the ideal design from a flicker standpoint.

The PID temperature controller may simplified to a proportional controller in order to minimize the processor overhead as the processor is also controlling all of the other engine functions such as paper path timing etc. The controller output for the proportional controller case is $$w_n=w_{n-1}+k_0e_n+k_1e_{n-1} \quad \text{eq. 5}$$

where the constants $k_0$, and $k_1$ are simply $$k_0=k_p \quad \text{eq. 6}$$

$$k_1=-k_p \quad \text{eq. 7}$$

as the integral gain, $k_i$, and the differential gain, $k_d$, have been set to zero.

In order for the proportional temperature controller and its associated power electronics to exhibit minimum flicker the proportional gain must be selected for a maximum rate of power change from zero power to full power in a time interval of at least one second or in other words a controller bandwidth of less than one hertz.

Gain scheduling may be accomplished by modifying the individual gains of the temperature control system upon reaching operating temperatures to further alter the dynamics of the temperature controller. Depending on the thermal mass of and transport lag of the fusing system the gains of the temperature controller may be increased or decreased in order to optimize the fuser temperature control as thermal transient loads pass through the fusing system.

The preferred embodiment of the present invention uses an adaptive control system based on an adaptive linear combiner using an LMS (Least Mean Square) type of algorithm such as taught by Widrow, B. & Sterns, S., "Adaptive Signal Processing", ISBN 0-13-004029-01 (1985) (herein incorporated by reference). Adaptive control systems are very attractive in that they can be implemented with very little knowledge of the system to be controlled as they will adapt themselves to the problem. Adaptive control systems can be easily modified for fast or slow adaptation and can thus, adapt quickly to bring a system under control and then switch to slow adaptation for fine control around a desired set point.

The preferred embodiment uses a one weight adaptive structure and an LMS type algorithm. A simple one weight approach has many advantages with the greatest being the ability to replace the existing control system without undue processor overhead. This allows for the highest probability of implementation in a mass produced printer or copier.

Experimentation with a standard LMS adaptive system as described by Widrow showed that the system was stable and converged to a solution. However, it was found that the temperature of the fuser did not equal the desired temperature. This is due to the weight scaling of the measured temperature by the adaptive system as taught by Widrow. Therefore modification of the system is necessary to make the desired temperature $d_k$ dimensionally equivalent to the output of the adaptive linear combiner. This could be easily accomplished by multiplying the desired temperature by the present weight vector $w_k$ resulting in a new desired signal which constantly changes as the weight changes. This does not violate any of the design methodologies of adaptive systems. The new weight scaled desired temperature is just treated as the desired signal for the system and is dimensionally equivalent to the weight scaled measured temperature. Alternatively, the weight scaling of the corrected temperature measurement could be eliminated and the original desired temperature could be utilized. This approach does alter the form of the adaptive linear combiner and the performance surface however it is very easily implemented.

Figure 4:
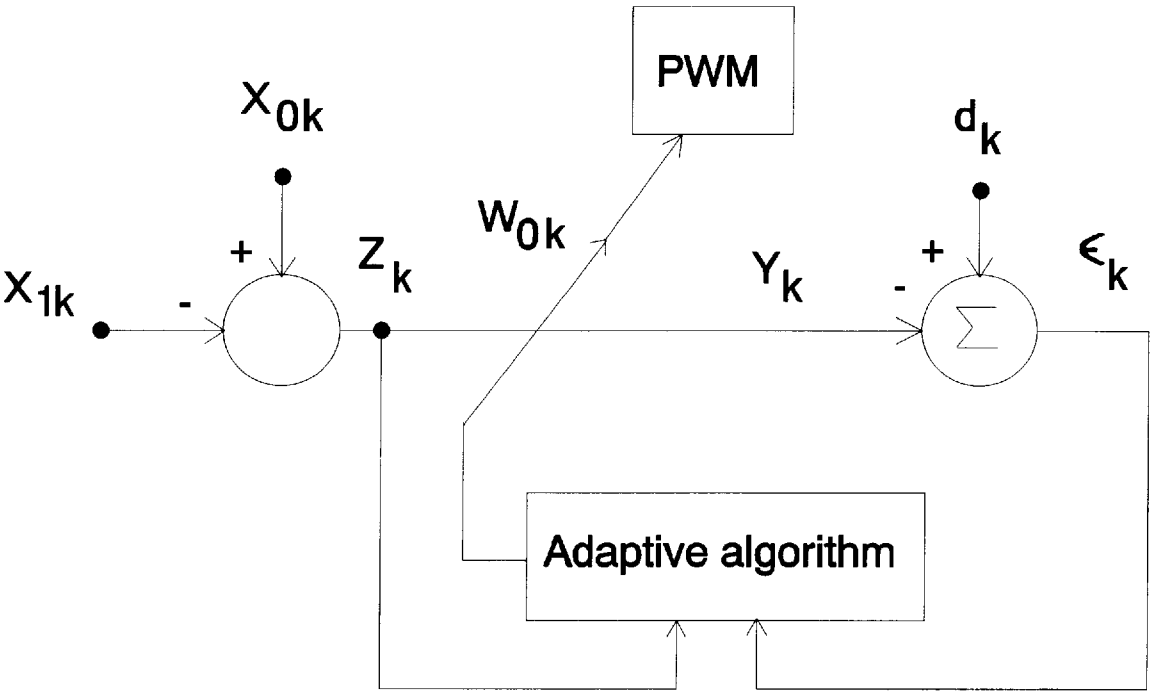
FIG. 4 shows a modified single input single weight adaptive temperature control system.

The multiplication of the corrected measured temperature by the adaptive weight vector was removed and the weight vector was instead supplied directly to the pulse width modulator. The output of the adaptive linear combiner, $y_k$, is now just the corrected positive temperature coefficient fuser temperature measurement, $x_k$. A diagram of this system is shown in FIG. 4.

The instantaneous error signal, $\epsilon_k$, for this modified adaptive system is now of the form $$\epsilon_k=d_k-x \quad \text{eq. 8}$$

and the instantaneous square error, $\epsilon_k^2$, is now of the form $$(\epsilon_k)^2=(d_k-x_k)^2=(d_k)^2-2\cdot(d_k\cdot x_k)+(x_k) \quad \text{eq. 9}$$

which is a parabola but not dependent on the system weight, $w_k$. This is different from, and apparently not in conformance with, the methods of Widrow.

The steady state temperature of the fuser is the product of the power delivered to the fuser and the thermal resistance, $R_\Theta$, of the fuser to the ambient environment or $$T=P\cdot R_\Theta=\frac{V^2\cdot d}{R}\cdot R. \quad \text{eq. 10}$$

For the time being the dynamics of the fusing system thermal resistance are being ignored such that the error surface of the modified LMS system may be examined.

Figure 5:
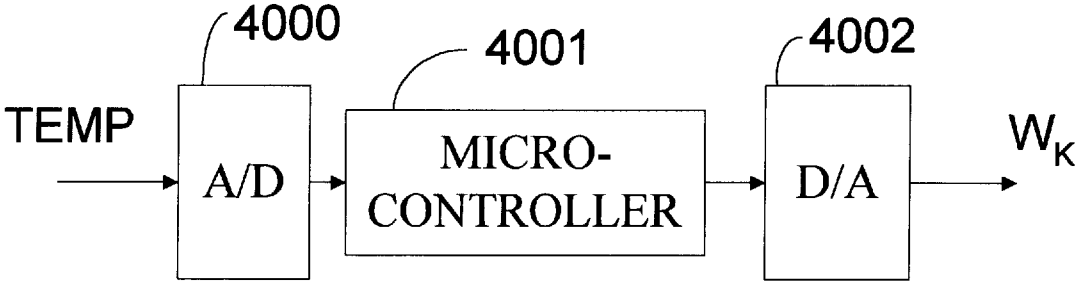
FIG. 5 is a block diagram of the controller of FIG. 3.

Referring to FIGS. 3 and 5, in the preferred embodiment the weight of the control system, $w_k$, is converted to an analog voltage by a micro-controller 4001 controlled D/A 4002 converter whose maximum output is 5 volts. The analog voltage from the D/A converter is in turn supplied to the power electronics 301 which is designed for a duty cycle of 1 when its input voltage is equal to 5 volts. additionally, the power electronics linearly 301 control the power as a function of the duty cycle. Thus, the duty cycle can be expressed as a linear function of the control system weight as $$d = \frac{w_k}{5} \quad \text{eq. 11}$$

Substituting equation 11 into equation 10 yields the fuser temperature as $$T = \frac{V^2 \cdot R_\theta \cdot w_k}{R \cdot 5} \quad \text{eq. 12}$$

which is the positive temperature coefficient input to the adaptive linear combiner $$x_k = T = \frac{V^2 \cdot R_\theta \cdot w_k}{R \cdot 5} \quad \text{eq. 13}$$

Therefore at the steady state the input signal can be considered a system constant, c, times the weight vector or $$x_k = c \cdot w \quad \text{eq. 14}$$

and the error surface of equation 9 is quadratic with an imbedded weight multiplication when the system is near steady state. This fits the Widrow model with the system constant, c, corresponding to the response of the system. Due to the design of the system the measured temperature, $x_k$, has already been multiplied by the weight vector. Based on this line of reasoning it is appropriate to utilize the standard LMS gradient estimate for this modified system.

The system constant, c, changes for changes in AC source voltage, for changes in the heating element resistance, for changes in the thermal resistance of the fusing system as its rotational speed changes, as the ambient relative humidity changes, as the ambient environmental temperature changes and as media loads enter and leave the fuser platens.

The modified LMS weight update equation for this one weight adaptive system is $$W_{k+1} = W_k + 2\mu\epsilon_k X_k \quad \text{eq. 15}$$

where $W_{k+1}$ is the next state value of the system weight, $W_k$ is the present value of the system weight, $\mu$ is the adaptation coefficient, $\epsilon_k$ is the error signal (which is the desired temperature minus the measured temperature), $x_k$ is the present measured temperature and the variable k is a time index.

The adaptation coefficient, $\mu$, is chosen such that linear one second ramps of the controller weight, $W_{k+1}$, are generated by the adaptive temperature control system. The phase lag of the fusing system causes the error signal, $\epsilon_k$, of the control system and the measured temperature, $x_k$, to essentially remain constant thereby automatically generating the linear ramping of the controller weight. Also recall that the adaptive controller weight, $W_{k+1}$, is directly controlling the duty cycle of the pulse width modulator and that the duty cycle of the pulse width modulator linearly controls the power supplied to the fusing system.

Fuser 302 also exhibits a large amount of pure time delay. With fuser 302 exhibiting pure time delay (i.e., phase lag) for a given time after a change in its input power, the temperature and hence the error signal of the control system remains constant. While the error is constant the next adaptive weight (Wk+1) of eq. 15, which is linearly controlling the average power delivered to the fuser, increases or decreases linearly. The phase lag causes the temperature controller to oscillate, similar to a proportional controller with high gain.

Short term flicker measurements were performed on the printer under standard triac control and under control of the modified one weight LMS controller coupled with the new power control topology. These flicker measurements were performed with a 120 Vrms 60 Hz source with the printer printing continuously at its rated speed of 10 pages per minute. The flicker measurement for the standard triac based fusing power controller for a 5 minute short term flicker test was $P_{st5min}$=3.86. Ten minute flicker was found to be $P_{st10min}$=1.35. The first pass flicker measurement for the new power controller with the simple one weight modified LMS controller with 1 second linear duty cycle ramping yielded a $P_{st5min}$=0.875 and 10 minute flicker was $P_{st10min}$=0.77. This improvement would allow this printer, which currently fails the proposed European flicker limits, to pass.

The temperature controller with modification for gain scheduling and duty cycle limiting altered the power fluctuations from 950 W for 4 seconds out of every 10 seconds to approximately 440 W for 26 seconds every 30 seconds. The flicker generated by the fusing system dropped to $P_{st10min}$=0.22. Recall in the previous implementation that did not utilize gain scheduling or duty cycle limiting that the short term flicker was measured at $P_{st10min}$=0.77.

Further optimization could be made to the simple temperature controller through empirical testing to determine the best minimum duty cycle, maximum duty cycle, and adaptation coefficient for optimum fuser temperature control. This will allow the printer engine firmware designer to compensate for the phase lag of the system without implementing a more elaborate control system. These empirical methods are utilized extensively in printer design due to the wide variety of paper weights, widths and lengths that the customer uses for everyday printing needs.

It is interesting to again note that even with the modifications for gain scheduling and maximum duty cycle limiting the temperature controller is still behaving like an oscillating proportional temperature controller. Of course it does possess extremely low flicker levels which are very desirable. Also, the temperature performance was acceptable. These modified LMS type controllers had to use a relatively high adaptation coefficient to obtain satisfactory temperature control performance when paper was running through the printer fusing system. These high adaptation coefficient LMS based controllers and the inherent pure time delay of the fusing system cause them to perform very similarly to classic proportional controllers with the power levels fluctuating as temperature is maintained.

Further reductions in the adaptation coefficient, $\mu$, should stabilize the temperature controller at the expense of inferior response to the unknown thermal loads of the printed media passing through the fuser. Also a more rigorously designed LMS type adaptive control system with a large transverse filter and additional weights for sensing impending thermal loads could solve the power fluctuation problem but would require additional processor overhead or additional expense in the control computer. Neither of these options are presently viable as the typical printer engine utilizes one control computer for all paper path timing, electrophotographic process control, fuser temperature control, control of all peripheral circuits, such as fan speeds, and finally must communicate with the computer which is generating the rasterized print image data. All of this overhead already designed into the print engine control computer does not allow for much additional processor time for more elaborate fuser temperature control algorithms.

The combined system consists of a method for determination of the supply voltage that the system is connected to. From the supply voltage information minimum and maximum duty cycles or conduction angles are determined for universal voltage interface operation and compensation of parasitic power losses in the idle mode and for the case of platen rotation. Upon the fuser reaching operating temperatures the maximum power level supplied to the fusing system is reduced and the dynamics of the temperature controller are altered. This combined system yields the desired universal voltage interface, provides acceptable fuser temperature control of the fusing system at full printing speed and exhibits excellent flicker performance as well.

Although the preferred embodiment of the invention has been illustrated, and that form described, it is readily apparent to those skilled in the art that various modifications may be made therein without departing from the spirit of the invention or from the scope of the appended claims.

What is claimed is:

1. A method for controlling power consumed by a heating element in an imaging device, said method comprising the steps of:

determining the input voltage;

first setting a maximum amount of power that can be consumed by said heating element, said maximum amount being related to said input voltage;

second setting a minimum amount of power that can be consumed by said heating element, said minimum amount being related to said input voltage;

smoothly ramping power consumed by said heating element from an initial amount to said maximum amount; and invoking a temperature control process to maintain said heating element at a set temperature.

2. The method of claim 1 further comprising the step of third setting a maximum rate of change for said amount of power consumed by said heating element, said maximum rate of change being related to said input voltage.

3. The method of claim 1 further comprising the step of first entering an idle mode.

4. The method of claim 3 wherein said step of first entering further comprising the step of smoothly reducing said maximum amount.

5. The method of claim 3 further comprising the step of second entering a power save mode.

6. The method of claim 5 wherein said step of second entering further comprising the step of smoothly reducing said power consumed by said heating element to zero.

7. The method of claim 1 wherein said temperature control process is an adaptive type process.

8. The method of claim 1 wherein said temperature control process is an proportional, integral, derivative type process.

9. A method for controlling a temperature of a heating element, said method comprising the steps of:

allowing said heading element to consume an initial amount of power;

measuring a rate of change in said temperature of said heating element;

determining an input voltage using said rate of change;

first setting a maximum amount of power that can be consumed by said heating element, said maximum amount being related to said input voltage;

second setting a minimum amount of power that can be consumed by said heating element, said minimum amount being related to said input voltage;

smoothly ramping over a period of time power consumed by said heating element from said initial amount to said maximum amount; and invoking an adaptive type temperature control process to control said temperature of said heating element.

10. The method of claim 9 further comprising the step of third setting a maximum rate of change for said amount of power consumed by said heating element, said maximum rate of change being related to said input voltage.

11. The method of claim 9 further comprising the step of first entering an idle mode.

12. The method of claim 11 wherein said step of first entering further comprising the step of smoothly reducing said maximum amount.

13. The method of claim 11 further comprising the step of second entering a power save mode.

14. The method of claim 13 wherein said step of second entering further comprising the step of smoothly reducing said power consumed by said heating element to zero.

15. A method for controlling a temperature of a heating element, said method comprising the steps of:

allowing said heading element to consume an initial amount of power;

measuring a rate of change in said temperature of said heating element;

determining an input voltage using said rate of change;

first setting a maximum amount of power that can be consumed by said heating element, said maximum amount being related to said input voltage;

second setting a minimum amount of power that can be consumed by said heating element, said minimum amount being related to said input voltage;

smoothly ramping over a period of time power consumed by said heating element from said initial amount to said maximum amount; and invoking a proportional, integral, derivative type temperature control process to control said temperature of said heating element.

16. The method of claim 15 further comprising the step of third setting a maximum rate of change for said amount of power consumed by said heating element, said maximum rate of change being related to said input voltage.

17. The method of claim 15 further comprising the step of first entering an idle mode.

18. The method of claim 17 wherein said step of first entering further comprising the step of smoothly reducing said maximum amount.

19. The method of claim 17 wherein said step of first entering further comprising the step of smoothly reducing said maximum amount.

20. The method of claim 19 wherein said step of second entering further comprising the step of smoothly reducing said power consumed by said heating element to zero.

* * * * *